US005284257A

United States Patent [19]

Schum

[11] Patent Number: 5,284,257

[45] Date of Patent: Feb. 8, 1994

[54] MODULAR SELF-SERVICE MERCHANDISE DISPLAY RACK

[75] Inventor: Richard Schum, Winston-Salem, N.C.

[73] Assignee: Chesapeake Display and Packaging Company, Winston-Salem, N.C.

[21] Appl. No.: 966,736

[22] Filed: Oct. 26, 1992

[51] Int. Cl.[5] ..... A47F 5/00

[52] U.S. Cl. ..... 211/59.2; 211/87; 211/94; 211/128

[58] Field of Search ..... 211/59.2, 94, 87, 55, 211/128; 312/42

[56] References Cited

U.S. PATENT DOCUMENTS

| | | | |
|---|---|---|---|
| D. 280,959 | 10/1985 | Sperry . | |
| 1,911,368 | 5/1933 | Kress | 211/59.2 |
| 2,943,742 | 7/1960 | Colley . | |
| 3,568,854 | 3/1971 | Welch . | |
| 3,915,306 | 10/1975 | Desisto et al. . | |
| 4,183,438 | 1/1980 | Huczek . | |
| 4,187,948 | 2/1980 | Perrella . | |
| 4,356,923 | 11/1982 | Young et al. | 211/59.2 |
| 4,369,887 | 1/1983 | Emery . | |
| 4,387,810 | 6/1983 | Crosslen . | |
| 4,531,646 | 7/1985 | Howard . | |
| 4,576,292 | 3/1986 | Percival | 211/88 X |
| 4,762,235 | 8/1988 | Howard et al. . | |
| 4,785,944 | 11/1988 | March . | |
| 4,817,900 | 4/1989 | Whittington et al. | 211/88 X |
| 4,844,266 | 7/1989 | Small et al. | 211/88 |
| 4,923,070 | 5/1990 | Jackle et al. . | |
| 4,925,038 | 5/1990 | Gajewski . | |
| 4,936,468 | 6/1990 | McNabb . | |
| 4,938,366 | 7/1990 | Carroll | 211/128 X |
| 5,172,815 | 12/1992 | Schock et al. | 211/59.2 X |

*Primary Examiner*—Robert W. Gibson, Jr.
*Attorney, Agent, or Firm*—Bell, Seltzer, Park & Gibson

[57] ABSTRACT

A modular self-service merchandise display rack is provided having a pair of oppositely spaced apart side support members in cooperating relationship with each other. Each of the side support members having a plurality of vertically spaced shelf-like tiers formed integrally therewith and downwardly inclined from the back of said support member so as to urge articles of each level therein to slide forward as each article in the front of the tier is removed from the shelf formed by the side supports. Alternatively, the display rack may include at least one interior support member having shelf-like tiers on each side of a central wall and located in cooperating relationship between the side support members to form a plurality of tiers.

8 Claims, 6 Drawing Sheets

MODULAR SELF-SERVICE MERCHANDISE DISPLAY RACK

BACKGROUND OF THE INVENTION (1) Field of the Invention

The present invention relates to modular self-service merchandise display racks for displaying and providing easy access to articles and packages of articles. More specifically, the invention relates to a modular self-service merchandise display rack having a plurality of shelves or tiers on which articles are readily accessible, and whose width is adjustable to meet many dimensions.

(2) Description of the Prior Art

As more merchants utilize self-service presentation of merchandise, display of products and efficient use of shelf space become increasingly important. Frequently a plurality of articles are packaged in plastic bags where the bag is closed with a header tag and displayed on a hanger protruding from peg board or the like. While presentation of merchandise in this manner has a certain appeal, it does not generally make the most efficient use of display space.

As stores have moved to the presentation of merchandise in a self-service manner, a variety of merchandise display systems have been proposed. Frequently display systems take up a great deal of space such as the hanger system described above, or the displays are of the rigid shelf variety which are cumbersome or do not lend themselves to storage and presentation of the maximum amount of merchandise.

An additional deficiency in the display racks of the prior art include those display fixtures which are difficult or are perceived to be difficult by store personnel who restock and repeatedly frustrate customers by being difficult to view and access the merchandise.

Another type of often-used display racks includes devices having downwardly inclined trays providing gravity feed. Included among these types of devices are those disclosed in U.S. Pat. No. 4,923,070 to Jackle, et al. and U.S. Pat. No. 4,531,646 to Howard, each of which uses trays for storing articles to be dispensed which are slidably secured on an elongated support by a guide retainer.

An improved self-service merchandising device is provided in the form of a modular display rack which enables the store owner to display a wide variety of products as well as providing a bulk supply of each SKU. The display rack enables the store proprietor to minimize cost by not having to restock the display case frequently and presents an attractive display of the merchandise.

SUMMARY OF THE INVENTION

In accordance with the present invention, a modular self-service merchandise display rack having a pair of opposed spaced apart side support members in cooperating relationship with each other is provided. Each of these side supports has a plurality of vertically spaced shelf-like tiers formed integrally therewith and extending outwardly and slightly downwardly inclined from the back of said side support member so as to urge articles of each level therein to slide forward as each article in the front of the tier is removed from the shelf-like tier. The front of the shelf-like tier has a frontal support means which is integral with each of the shelf-like tiers whereby the articles can be placed upon the shelf-like tiers and slanted in accessible fashion with the forwardmost of the articles resting against the interior of the frontal support.

In a preferred manner, each of the succeedingly lower tiers protrudes further from the rear of the side support member so that each shelf-like tier on each succeedingly lower level protrudes further than the one above providing easy access to the articles or packages on that tier. The pair of opposed spaced apart side supports are mounted either on a wall support system, or on a peg board or may be mounted to a self supporting base member.

An additional embodiment of this invention is to have a interior support member which is similar in structure to the side support means having frontal support means extending on either side of the central support means in which two tier like shelves may be placed side by side. Of course, it is easy to see that any number of central support system means may be utilized to provide as many sets of shelf-like tiers as desired. The support members are spaced apart by widths appropriate for the particular article which is to be carried by the display rack. In particular, this type of display rack is especially adaptable for displaying video cassettes in 3, 4 or 5 packs.

It is therefore an object of the present invention to provide a modular self-service merchandising display rack for displaying articles or packages of articles and providing easy access to the articles or packages.

Another object of the present invention is to provide a modular self-service display fixture which may be attached to a wall in which product units may be loaded and inventoried from the front of the fixture.

Yet another object of the present invention is to provide a modular self-service display rack which is particularly adapted for housing multiple units of cassette tapes.

BRIEF DESCRIPTION OF THE DRAWINGS

These and other objects, features and advantages of the invention will be more readily apparent from the following detailed description of the drawings in which.

DETAILED DESCRIPTION OF THE INVENTION

Figure 1:
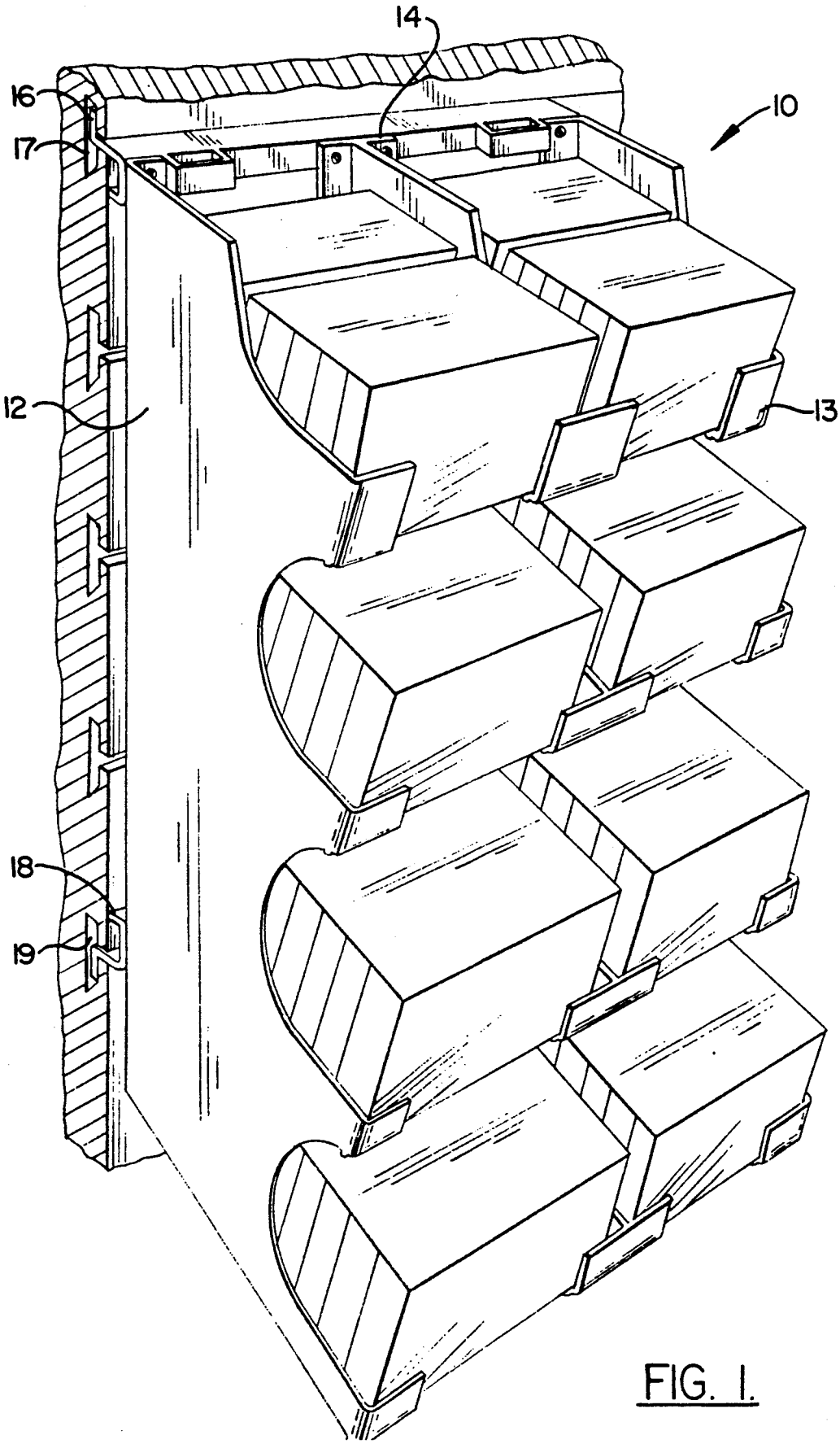
FIG. 1 is a perspective view of an embodiment of the modular self-service display rack of the present invention.

Referring now to the drawings, and in particular to FIG. 1, there is shown a preferred embodiment of a modular self-service merchandise display rack of the present invention generally indicated at 10. The modular self-service display rack shown in FIG. 1 is useful for displaying articles or packages of articles and providing easy access to the articles. The modular self-service display rack shown in FIG. 1 is particularly useful for displaying packages of audio and video cassettes and the like. As will be appreciated, other articles, both packaged and unpackaged, may be displayed. The modular display rack 10 shown in FIG. 1 comprises a pair of vertical side support members 12 and 13 which are mirror images of each other and interior support member 14. The side support members 12, 13 and interior support member 14 are affixed to upper support bracket 16 and lower support bracket 18 at predetermined widths to form a display rack. The modular display rack is affixed to a wall by upper support bracket 16 snugly fitted into wall slot 17 and by lower support bracket 18 fitted in wall slot 19.

Figure 14:
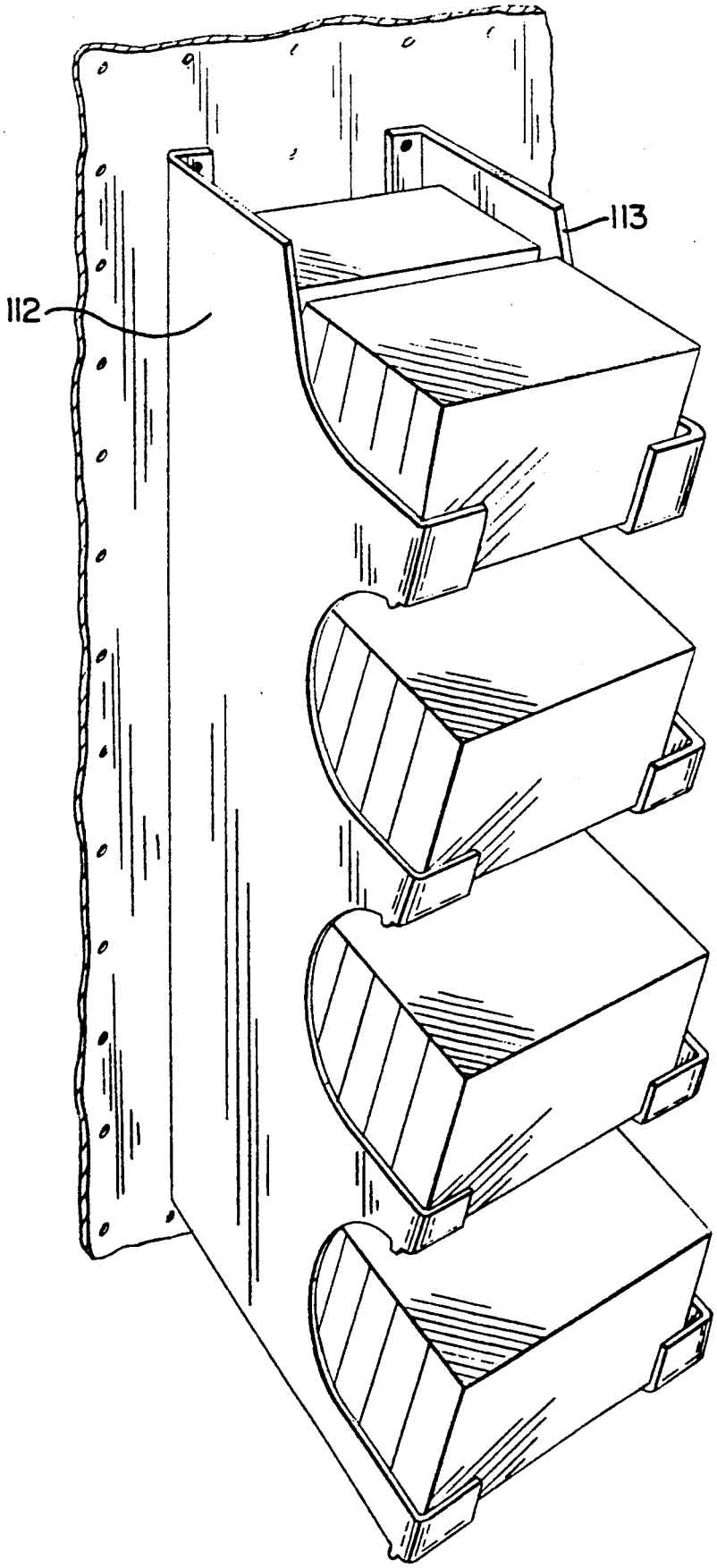
FIG. 14 is a perspective view of another embodiment of the modular self-service merchandise display rack of the present invention illustrating one set of tiered shelves.

As shown in the embodiment of FIG. 1, each of said side support members 12 and 13 are spaced apart and have a central support means 14 positioned therebetween. In another embodiment, as shown in FIG. 14 and explained more fully hereafter, the interior support member is not used. The modular self-service merchandise display racks shown in FIG. 1 and FIG. 14 are particularly suitable for location along the wall of a selling floor and as such, the products contained therein are clearly displayed to shoppers in the sales area. It should be understood that the display rack may also be used in connection with a freestanding base member (not shown).

Figure 2:
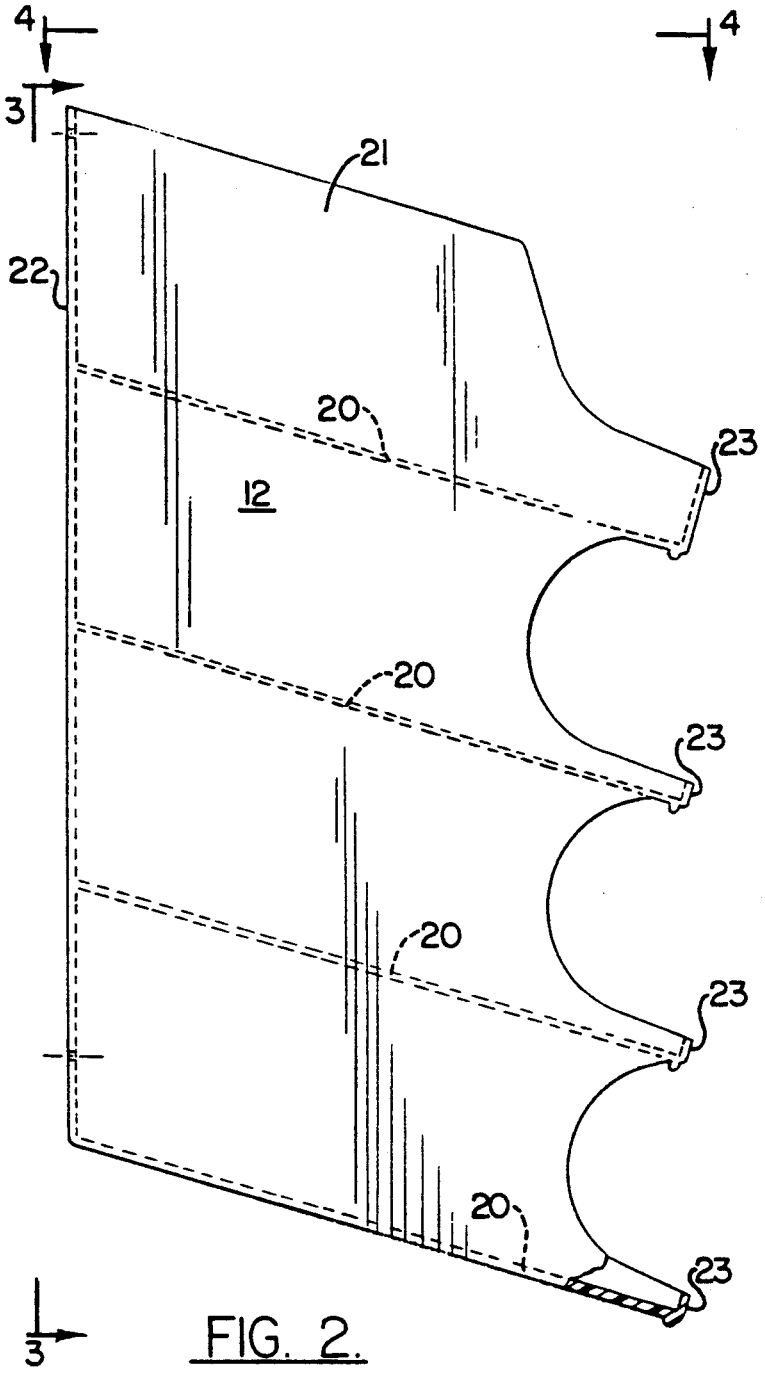
FIG. 2 is a side-elevational view of the side support member of the modular self-service display rack of the present invention.
Figure 3:
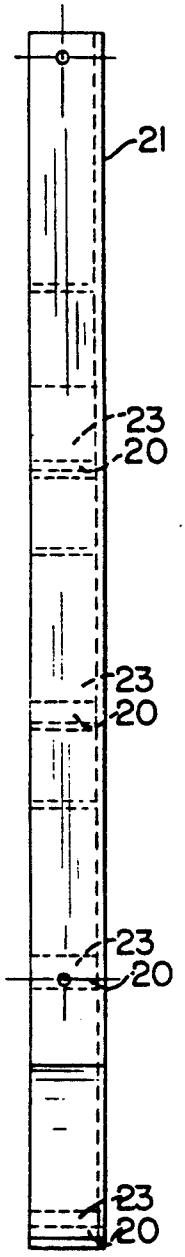
FIG. 3 is a rear view of the side support member of the modular display rack of the present invention taken along line 3—3 of FIG. 2.
Figure 4:
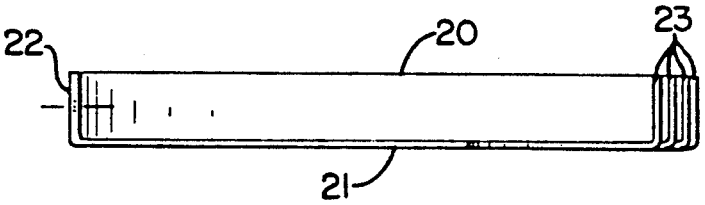
FIG. 4 is a top view of the side support member of the modular display rack of the present invention taken along line 4—4 of FIG. 2.

Referring now to FIGS. 2-4, there is exemplified in greater detail the side support members 12, 13. Side support member 13 is a mirror image of side support member 12. Each side support member has a side wall 21, a rear wall 22 and a plurality of vertically spaced shelf-like tiers 20 formed integrally with the side unit.

As shown, each of these shelf-like tiers 20 extends outwardly and slightly downwardly inclined from the rear wall 22 of side support member 12 so as to urge the articles of each level therein to slide toward forward dispensing position as articles are removed from the shelf-like tier. The shelf-support tier 20 extends inwardly from side wall 21 of the side support member a distance sufficient to support one side of an article or package placed thereon. The shelf-like tiers are formed by frontal support means, lips 23 formed integrally with each of the shelf support tiers 20 whereby articles or packages can be placed on the shelf-like tiers 20 and slanted in accessible fashion, the ends of said articles resting against the frontal support, lips 23. It is generally preferred that lips 23 and 33 formed on the front end of each side support member and interior support member (See FIG. 7) extend inwardly only a distance sufficient to stop an article or a package so that the lips 23 and 33 form a slot therebetween for easy removal of an article or a package. While the support means of the present invention may be constructed of a variety of materials, it has been found preferable and particularly pleasing to the eye to have these support means molded of clear or smoked plastic.

As shown in particular in FIG. 2 in a preferred embodiment, each succeeding tier extends a greater distance from the rear wall 22 of the support member than the tier above it which provides for easy access to the articles displayed.

As shown in the embodiment of FIG. 1, the display rack may be setup in modular fashion with the shelf-like tiers being separated by interior support member 14. The modular system shown in FIG. 1 provides one or more interior support members. The width of each tier may be varied to suit the merchandise being displayed. The construction of interior support member 14 is shown in greater detail in FIGS. 5-7 wherein the construction of the interior support member is similar to the side support members except that shelf supports 30 are provided on both sides of center wall 31. Center wall 31 is integrally formed with the shelf supports 30 and rear wall 32. As shown, each of the shelf supports 30 extends outwardly and slightly downwardly inclined from rear wall 32 so as to urge the articles supported therein to slide toward a forward dispensing position as articles are removed from the rack. The shelf-like tiers are formed by frontal support means, lips 33 formed integrally with each of the shelf support tiers 30 whereby articles, or packages may be placed on the shelf-like tier 30, which is positioned in cooperating relationship with side support members 12, 13, and with shelf-like tiers 20 shelf supports are formed which include lips 23 33. The shelf support tiers 30 extend outwardly from center wall 31 a distance sufficient to support one side of an article or package placed thereon.

Figure 5:
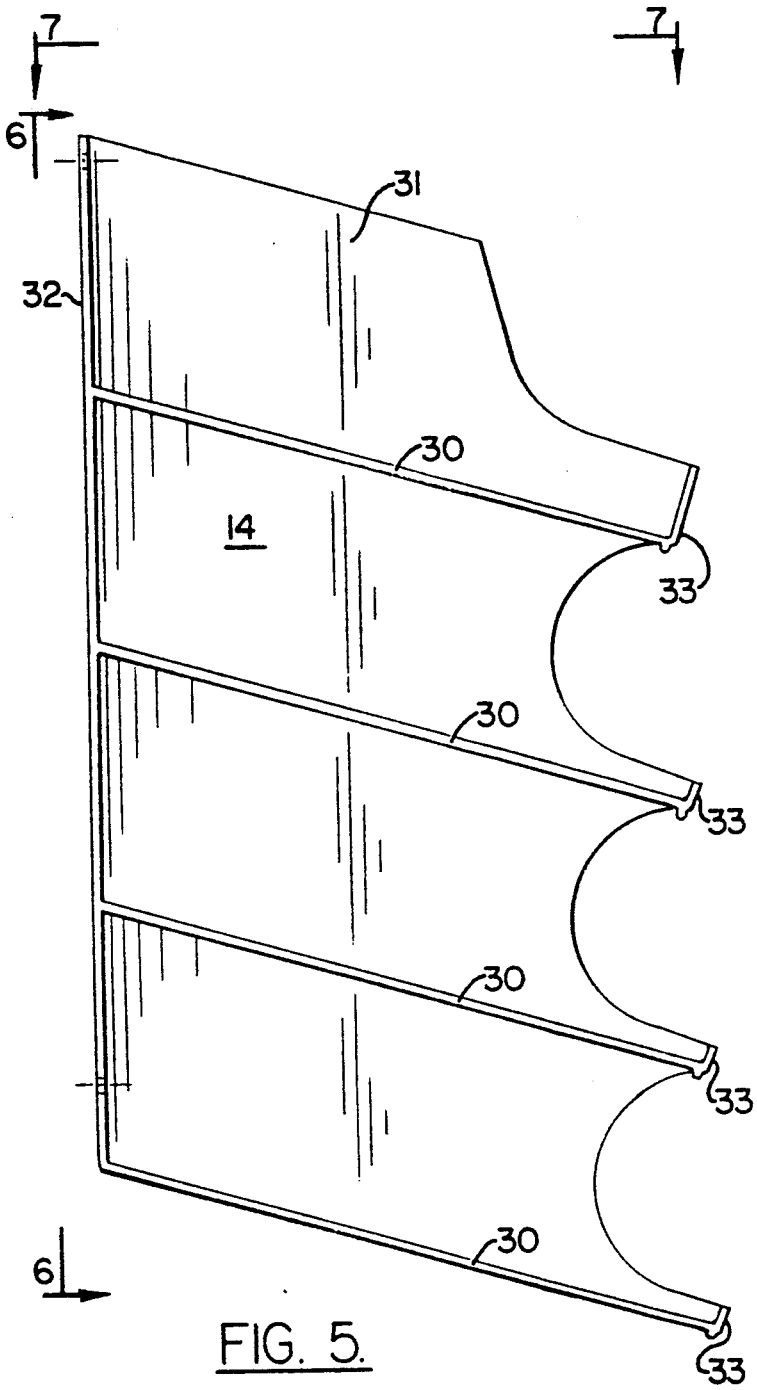
FIG. 5 is a side-elevational view of an interior support member of the modular display rack of the present invention.
Figure 6:
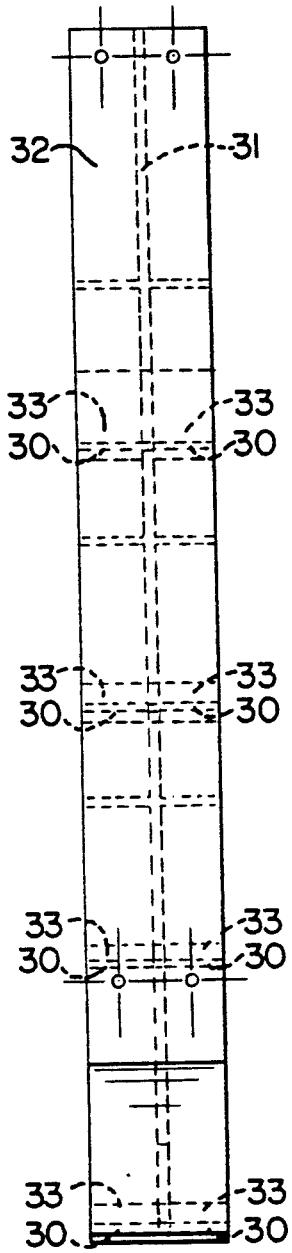
FIG. 6 is a rear view of an interior support member of the modular display rack of the present invention taken along line 6—6 of FIG. 5.
Figure 7:
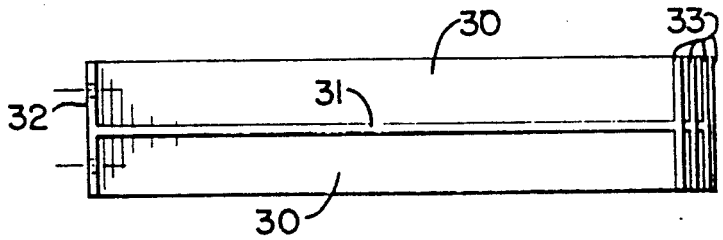
FIG. 7 is a top view of an interior support member of the modular display rack of this invention taken along line 7—7 of FIG. 5.

The side support members 12, 13 shown in FIGS. 2-4 and interior support member 14 shown in FIGS. 5-7 have mounting means on the rear walls 22, 32 thereof for attachment to upper support bracket 16 and lower support bracket 18. Side support members 12, 13 and interior support member 14 may be attached to other types of brackets or supports such as a freestanding support or peg board. The advantage of being readily able to adjust the width of the tier-like shelves should be readily apparent.

Figure 8:
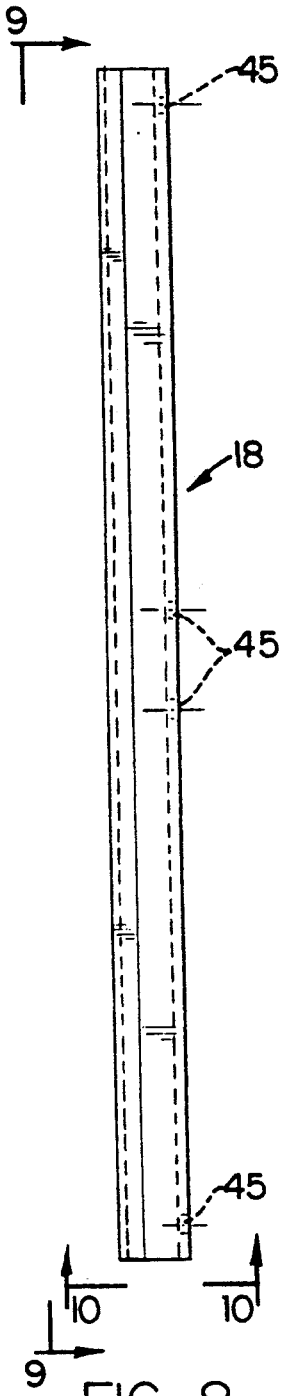
FIG. 8 is a top view of the lower support bracket of the modular display rack of the present invention.
Figure 9:
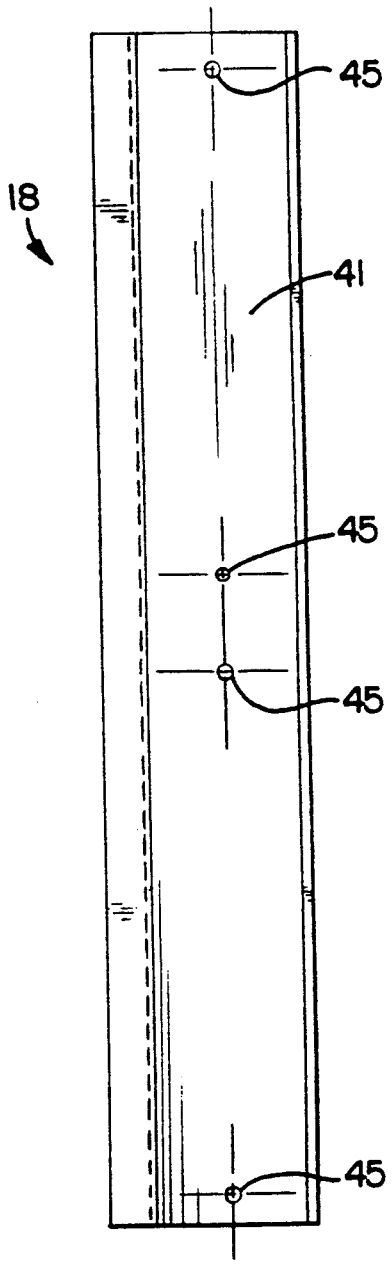
FIG. 9 is a rear view of the lower support bracket of the modular display rack of the present invention taken along, line 9—9 of FIG. 8.
Figure 10:
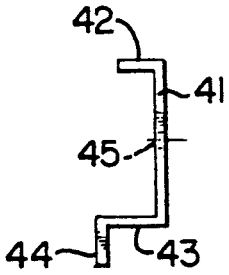
FIG. 10 is an end view of the lower support bracket of the modular display rack of the present invention taken along line 10—10 of FIG. 8.

As indicated above, modular display racks may be attached to a wall or other support by a variety of means. It has been found that a convenient means is to use upper support bracket 16 and lower support bracket 18. As shown in FIGS. 8-10, lower bracket 18 is an elongated strip. The bracket is sized so that when used With upper bracket 16, the modular display rack will be positioned perpendicular to the floor. As shown in FIG. 10, the lower bracket 18 is an elongated U-shaped member having a support wall 41 against which side support members 12, 13 and interior support member 14 rest and are attached through holes 45 and arms 42, 43. Flange 44 is formed integral with arm 43 and fits securely in wall slot 19 as shown in FIG. 1.

Figure 11:
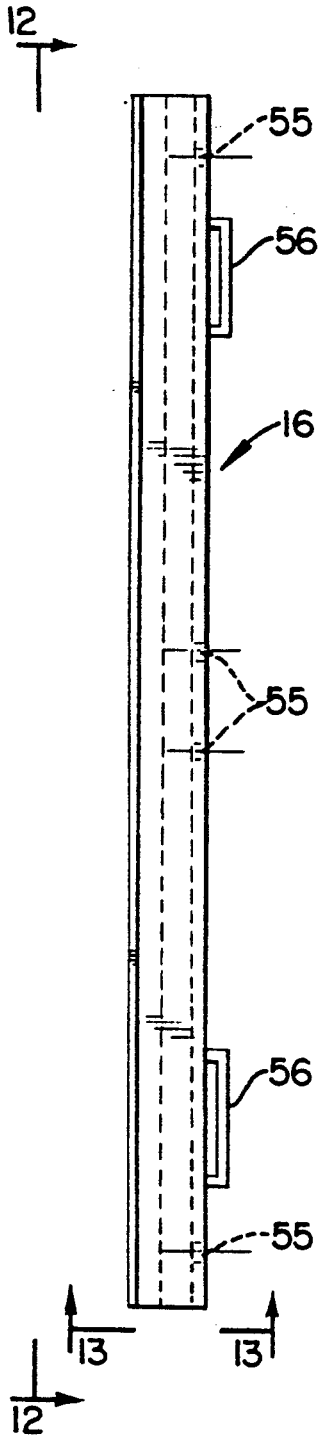
FIG. 11 is a top view of the upper support bracket of the modular display rack of the present invention.
Figure 12:
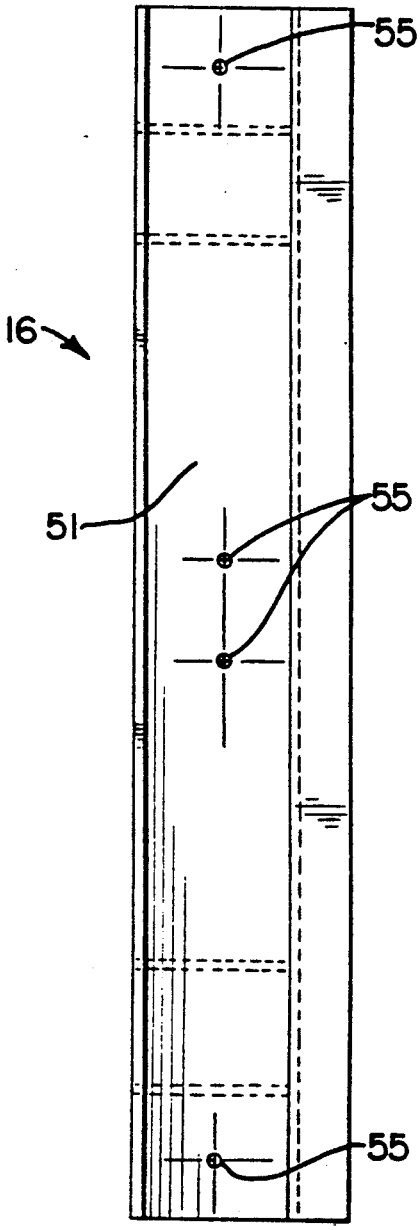
FIG. 12 is a rear view of the upper support bracket of the modular display rack of the present invention taken line 12—12 of FIG. 11.
Figure 13:
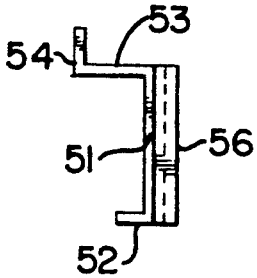
FIG. 13 is an end view of the upper support bracket of the modular display rack of the present invention taken along line 13—13 of FIG. 11.

Upper support bracket 16 is shown in greater detail in FIGS. 11–13. As shown, upper support bracket 16 is an elongated strip of desired length to accommodate one or more modules. Upper bracket 16 is preferably generally U-shaped having modular support wall 51 to which side support members 12, 13 and interior support member 14 are attached through holes 55 (by any suitable means) and arms 52, 53. Flange 54 is formed integral with arm 53 and fits securely into wall slot 17. Positioning members 56 are formed integral with upper bracket 16.

An alternative embodiment is shown in FIG. 14 wherein a modular self-service merchandise display rack is provided having only one tier of shelves formed from side wall members 112 and 113. As illustrated for the purpose of this embodiment, the display rack is attached to peg board, but may be attached as shown in FIG. 1 or any other suitable means.

The present invention makes possible displaying and vending of a large number of individual items within a relatively small wall space area. The items are easily accessible to potential customers since all they need to do is to remove an article or package from the shelf. Removal of one or more packages will automatically cause similar packages to slide into the easily accessible front position until such time as the contents of the particular shelf are exhausted. Suitable dimensions for any given modular merchandising display rack structure will vary, of course, with the environment in which it is to be utilized.

While a preferring embodiment of this invention has been illustrated in detail, it will be readily apparent to those skilled in the art that other embodiments may be conceived and fabricated without departing from the spirit and scope of this invention.

That which is claimed is:

1. A modular self-service merchandise display rack for displaying and permitting access to articles:

(a) a pair of opposed spaced apart vertical side support members in cooperating relationship with each other;

(b) each side support member having a plurality of vertically spaced apart shelf-like tiers formed integrally therewith and extending inwardly from said side support member for a distance sufficient to support one side of an article;

(c) said tiers extending outwardly from and downwardly inclined from the rear of each of said side support member so as to urge the articles of each shelf therein to slide toward a forward dispensing position as articles are removed from the shelf-like tier;

(d) frontal support means integral with each of said shelf-like tiers whereby articles can be placed upon said shelf-like tiers in slanted accessible fashion, the ends of said articles resting against said frontal support for ready access;

(e) at least one interior support member positioned in cooperating relationship with and in between said side support members, said interior member having a center wall and a plurality of vertically spaced shelf-like tiers formed integrally with and on each side of said center wall, said tiers extending outwardly from and downwardly inclined from the rear of said interior support so as to urge the articles of each shelf therein to slide toward a forward dispensing position as articles are removed from the shelf-like tiers;

(f) frontal support means integral with each of said shelf-like tiers whereby articles can be placed upon said shelf-like tiers in slanted accessible fashion, the ends of said articles resting against said frontal support; and (g) attachment for supporting each of said support members to a permanent fixture.

2. The modular self-service merchandise display rack according to claim 1 in which each succeeding lower tier extends further outwardly from the rear of said side support member than the tier above.

3. The modular self-service merchandise display rack according to claim 1 wherein said means for supporting each of said side support members and said interior support member are means for attaching said supports to a wall.

4. The modular self-service merchandise display rack according to claim 1 wherein said means for supporting each of said side support members and said interior support member are means for attaching said side supports to a self-supporting, freestanding fixture.

5. A modular self-service merchandise display rack for displaying and permitting access to articles:

(a) a pair of opposed spaced apart vertical side support members in cooperating relationship with each other;

(b) each side support member having a plurality of vertically spaced apart shelf-like tiers formed integrally therewith and extending inwardly from said side support member for a distance sufficient to support one side of an article;

(c) said tiers extending outwardly from and downwardly inclined from the rear of each said side support member so as to urge the articles of each shelf therein to slide toward a forward dispensing position as articles are removed from the shelf-like tier;

(d) frontal support means integral with each of said shelf-like tiers whereby articles can be placed upon said shelf-like tiers in slanted accessible fashion, the ends of said articles resting against said frontal support for ready access; and (e) attachment for supporting each of said side support members to a permanent fixture.

6. The modular self-service merchandise display rack according to claim 5 in which each succeeding lower tier extends further outwardly from the rear of said side support member than the tier above.

7. The modular self-service merchandise display rack according to claim 5 wherein said means for supporting each of said side support members are means for attaching said supports to a wall.

8. The modular self-service merchandise display rack according to claim 5 wherein said mans for supporting each of said side support members are means for attaching said side supports to a self-supporting, freestanding permanent fixture.

* * * * *